US006032428A

United States Patent [19]

Rosan et al.

[11] Patent Number: 6,032,428

[45] Date of Patent: Mar. 7, 2000

[54] MODULAR ROLL-OUT PORTABLE FLOOR FOR ICE SURFACES

[75] Inventors: Robert J. Rosan; Arnon J. Rosan, both of New York, N.Y.; Philip Newman, Boca Raton, Fla.

[73] Assignee: Ameritech Plastics Incorporated (A Delaware Corporation)

[21] Appl. No.: 08/958,277

[22] Filed: Oct. 27, 1997

[51] Int. Cl.[7] ..... E04B 2/46

[52] U.S. Cl. ..... 52/592.1; 52/177

[58] Field of Search ..... 52/592.1, 588.1, 52/177, 650.3, 100, 731.3, 732.2

[56] References Cited

U.S. PATENT DOCUMENTS

| | | | |
|---|---|---|---|
| 4,826,351 | 5/1989 | Haberhauer | 404/35 |
| 4,917,532 | 4/1990 | Haberhauer | 404/35 |
| 5,527,128 | 6/1996 | Rope | 404/35 |
| 5,758,467 | 6/1998 | Snear | 52/592.1 |
| 5,819,491 | 10/1998 | Davis | 52/592.1 |
| 5,833,386 | 11/1998 | Rosan | 404/36 |

*Primary Examiner*—Beth Aubrey
*Attorney, Agent, or Firm*—Darby & Darby

[57] ABSTRACT

A modular roll-out floor for use as a temporary, removable cover over an ice surface, the floor includes a plurality of interconnected and disconnectable treads. Each tread is made of three layers: a top portion is made of high impact plastic with an anti-slip surface on a honeycomb structural design for strength and rigidity, an intermediate portion designed as an insulating thermal barrier layer and a lower portion, which is also made of high impact plastic with a honeycomb structural design for strength and rigidity. The three portions are connected to each other. The treads may be connected to other treads to form a floor of any size. Living hinges on each tread allow the floor to be easily rolled up and stored.

18 Claims, 5 Drawing Sheets

MODULAR ROLL-OUT PORTABLE FLOOR FOR ICE SURFACES

BACKGROUND OF THE INVENTION

1. Field of the Invention

The present invention relates to a roll-out flooring for covering ice surfaces of any size. It is often desirable to convert the use of an ice surface into a non-slip, safe walking surface, for example, in a stadium or an arena to utilize the space for a different event or purpose, and after the event is over, to quickly reconvert the surface back to the ice surface in order to optimize the use of the stadium or arena. It might also be desirable to provide only a portion of an ice surface with a walking area, for example, to facilitate safe walking during an award ceremony or intermission entertainment at an ice skating or ice hockey event.

2. Description of the Related Art

It is known to cover an ice surface with a porous system made from plywood or Homasote®, which is known to absorb moisture and dirt and which deteriorates over time, and is cumbersome, difficult and time consuming to install and remove.

It is also known to provide ground coverings to temporarily utilize an outdoor area to provide a safe and stable surface for people to walk on and for equipment such as exhibit stands, podiums, tables and chairs, to stand on. Such ground covering is also provided to protect an expensive astroturf surface. It is also known to provide portable roll-out lengths of flooring which can be quickly mounted together to form entire floors of almost any size. Such roll-out floor is disclosed by applicants in U.S. application Ser. No. 08/547,800 and application Ser. No. 08/861,977, which specification is herewith incorporated by reference. However, none of the these latter discussed roll-out ground coverings are suitable for a unique surface such as ice. Although the placement of such roll-out coverings could provide a safe walkway on ice, it would not be an efficient, economical or sturdy enough cover to convert such surface into a space useful for non-ice related functions and events such as exhibitions or different sport activities. Even if such known floor covering would be rolled onto an ice surface, it would have certain drawbacks: first, the ice surface would not be thermally insulated and it would be uncomfortably cold and/or damp for people to stand on the surface for a long period of time, second, considerable energy is necessary to maintain the ice surface even though not utilized during the time the surface is converted for walking, third, the floor covering might slide if only portions of the ice were covered, and fourth, such single layer coverings would notbe rugged enough to stand the stress of utility and installation vehicles.

SUMMARY OF THE INVENTION

It is an object of the present invention to overcome the above mentioned disadvantages.

It is a further object of the present invention to provide a roll-out floor which is easy to install on an ice surface and provides a protective cover for either the entire ice surface or just a portion thereof, thereby providing a safe walkway.

It is another object of the present invention to provide a protective roll-out floor which adheres to the ice surface such that it does not move, even though the roll-out floor might only cover a portion of the ice surface.

It is still another object of the present invention to provide a protective roll-out floor which includes an insulation layer or a thermal barrier for insulating the area above the roll-out floor from the coldness and dampness of the ice surface and which insulates the ice from possibly melting at the surface, due to higher temperature in the arena during non-ice related functions. In other words, the invention contributes to saving energy necessary to maintain the ice surface sufficiently cool and/or for maintaining the temperature in the arena comfortably warm. The roll-out floor is designed so as to reduce condensation on the surface of the roll-out floor for the comfort of the people standing or walking on the roll-out floor, so that it remains safe for walking. Further, the more comfortable temperatures maintained above the roll-out floor do not penetrate through the insulated floor, and thus the ice surface does not unnecessarily melt.

It is still another object of the present invention to provide a protective roll-out floor which includes an additional insulating feature in form of having an internal structure, such as a honeycomb type structure, which provides air pockets when the floor is rolled out. These pockets trap the air in a structure within the roll out floor and, when rolled out, between the ice and the roll-out floor. The trapped air further promotes insulation.

It is still another object of the present invention to provide a protective roll-out floor that is strong enough to support the weight of a utility vehicle or a forklift moving equipment such as staging, seating, podiums or exhibit stands across the surface.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements through out the several views.

DETAILED DESCRIPTION OF THE PRESENTLY PREFERRED EMBODIMENTS

Figure 1:
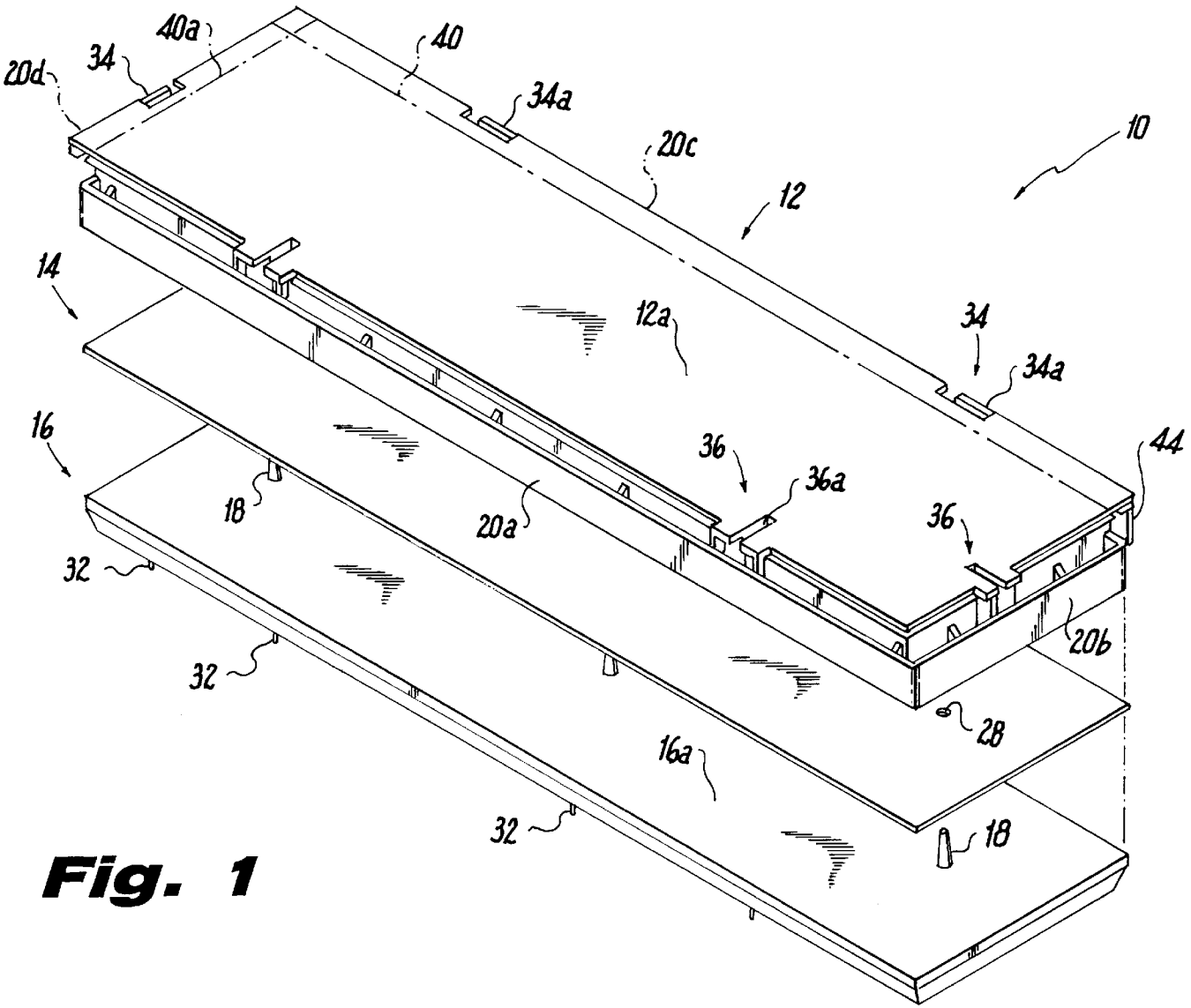
FIG. 1 is an exploded perspective of one tread of a protective rollout floor for covering an ice surface, showing an upper layer, an insulating middle layer and a bottom layer.
Figure 3:
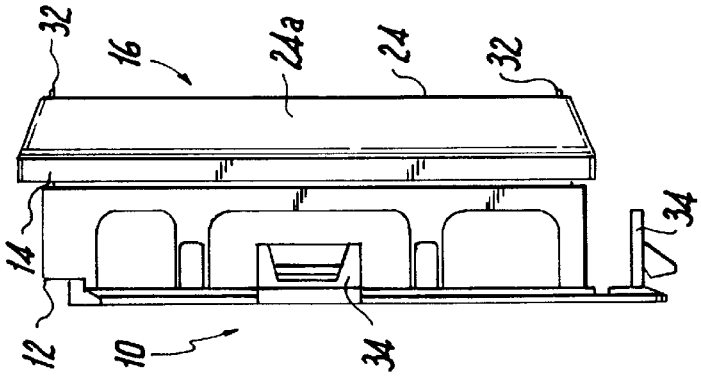
FIG. 3 is a end view of a tread.
Figure 2:
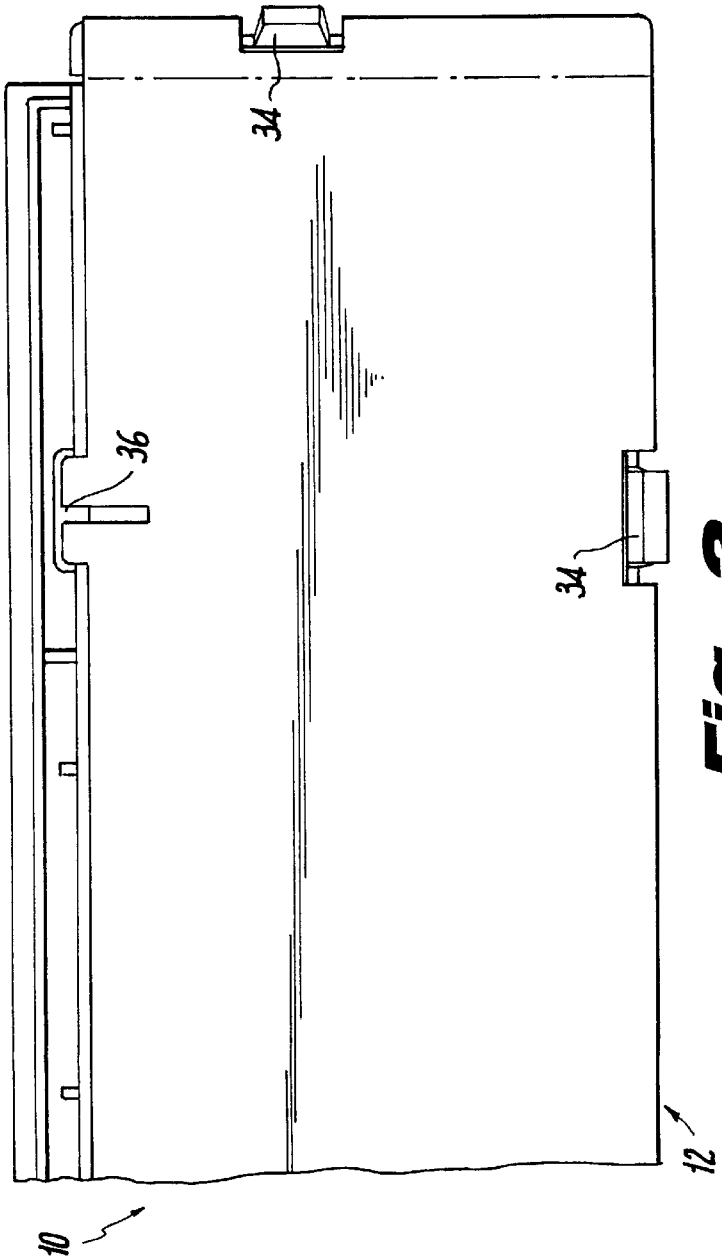
FIG. 2 is a top view of a portion of a tread.
Figure 4:
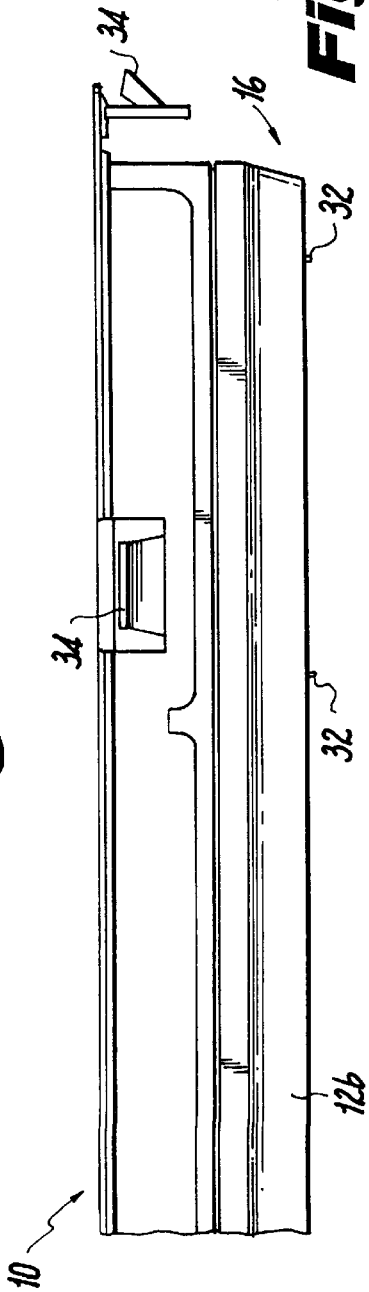
FIG. 4 is a side view of a portion of a tread.

Referring generally to FIGS. 1–8, the preferred embodiment of the present invention will now be described in detail. FIG. 1 illustrates an exploded perspective of one modular tread 10, which is assembled from a top portion 12 having a smooth but non-slip top surface 12*a*, an insulation layer 14 and a lower portion 16. Both, the top portion 12 and the lower portion 16 are manufactured, for example, by plastic molding, such as injection molding, of a light weight thermoplastic material, such as polypropylene. The top portion 12 has four side portions which are similar to those side portions disclosed in commonly owned application Ser. No. 08/833,386. Accordingly, the side portions comprise a female side portion 20*a*, a female end portion 20*b*, a male side portion 20*c* and a male end portion 20*d*. The male side portion 20*c* and the male side portion 20*d* are substantially identical to each other in function and design. Likewise, the female side portion 20*a* and the female end portion 20*b* are substantially identical to each other in function and design. The underside of the top portion is provided with a load bearing internal structure, such as a honeycomb rib structure 22 for providing structural stability and to facilitate insulation by forming closed air pockets when assembled with parts 14 and 16.

The lower portion 16 has a substantially flat top surface 16*a* and comprises four side portions, generally identified with 24, with 24*a* being the longer side, and 24*b* being the shorter side. All four sides are preferably tapered inwardly on their bottom sides. Similar to the top portion, the lower portion is also constructed with a load bearing structure, such as a honeycomb rib structure 26, for providing structural stability and to facilitate additional insulation by providing closed air pockets when resting on the ice.

Between the top portion 12 and the lower portion 16, there is provided a thermal barrier or an insulating layer 14. The insulating layer prevents most of the direct contact and, thus, transfer of cold and heat between the top portion 12 and the lower portion 16. However, for the insulating layer to be securely held between the top and the lower portion, a number of thin protruding prongs 18 are molded onto the otherwise flat surface 16*a* of the lower portion. The insulating layer has cut-outs 28 (see FIG. 1) which correspond to the position of the prongs 18 so as to hold the insulating layer into a designated position by the prongs 18. Correspondingly, the top portion comprises sockets 30 in the load bearing internal structure, or the honeycomb rib structure for accepting the prongs 18. When the prongs 18 are inserted into the sockets 30, the lower portion 16 is affixed to the top portion 12, but yet, the two portions are insulated from one another by the insulation layer, thus minimizing direct temperature transmission between the two portions. To promote affixation between the top portion and the lower portion, the prongs 18 may be, for example, sonically welded into the top portion, or affixed by snap-lock engagement. The insulating layer may be made of commonly known insulation material, such as foam placed on a mylar layer, a vinyl backed layer, or a sheet of polyethylene or polypropylene foam.

As can also be seen on FIGS. 1, 3, 4 and 8, a plurality of several small spikes 32 are provided on the bottom surface of the side portions of the lower portion 24. These spikes 32 may also be disposed on the bottom surface of the load bearing internal structure. Once the treads are connected to each other to provide flooring and rolled out over the ice surface, these spikes deter the flooring from moving on the ice surface.

Figure 5:
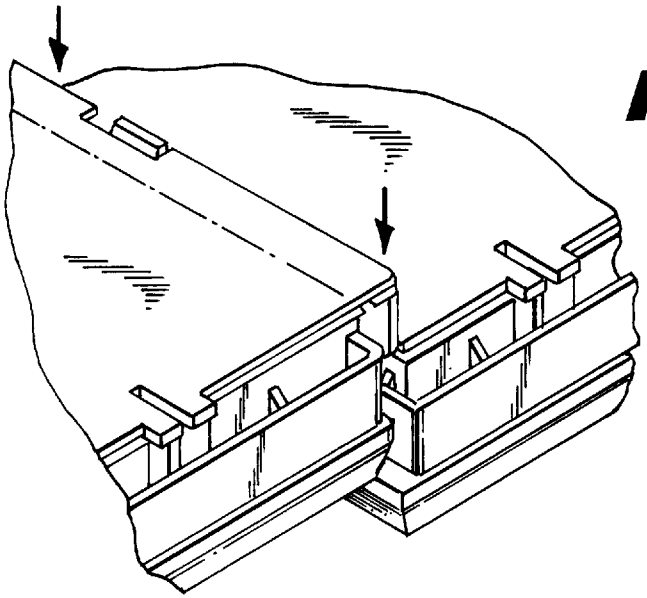
FIG. 5 is a perspective view of the interconnection of two adjacent treads.
Figure 6:
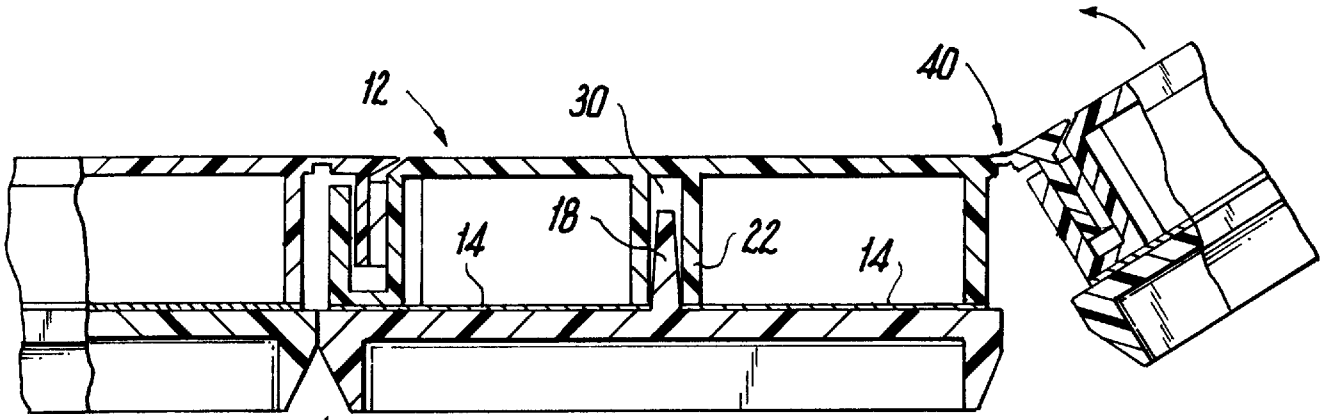
FIG. 6 is the end view partially in cross-section.
Figure 7:
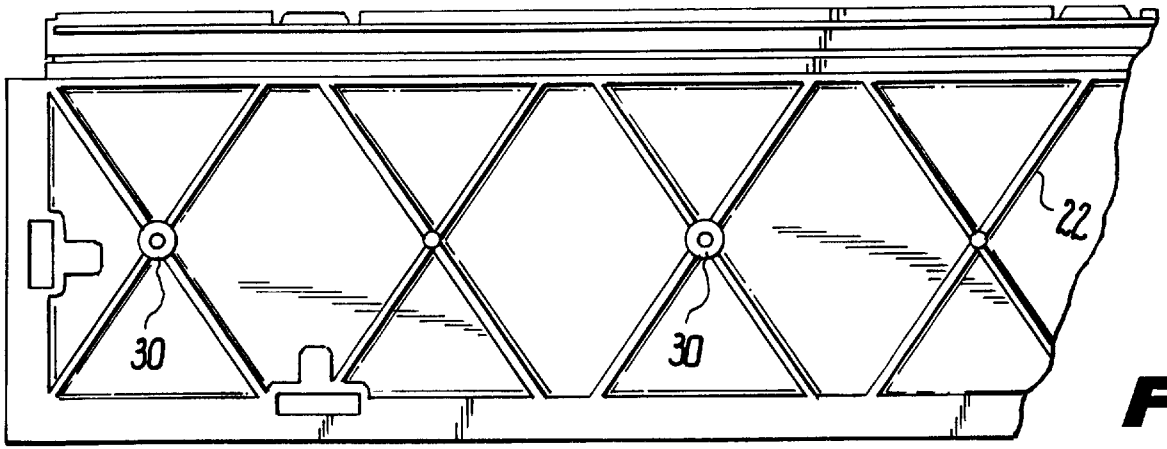
FIG. 7 is a bottom plan view of the top tread portion.
Figure 8:
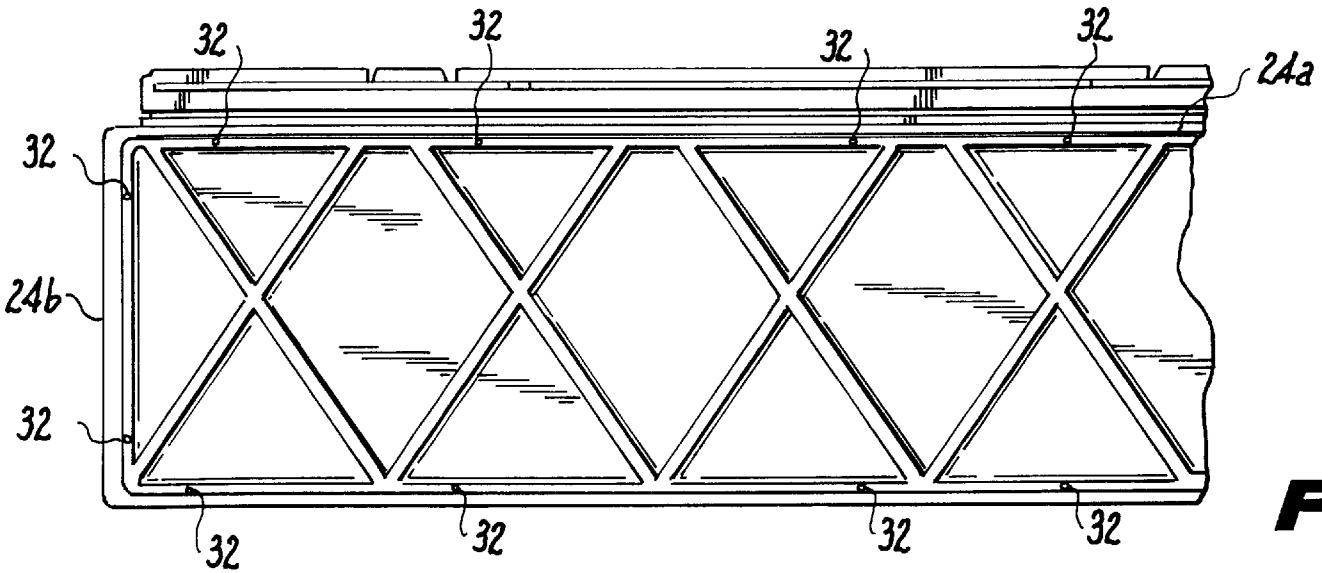
FIG. 8 is a bottom plan view of the lower tread portion.
Figure 9:
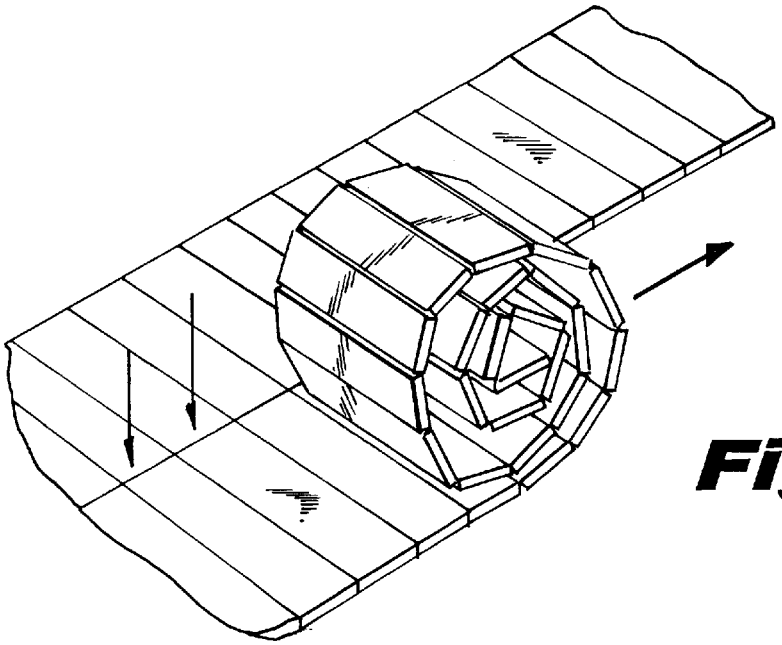
FIG. 9 illustrates a typical installation of the roll-out floor.
Figure 10:
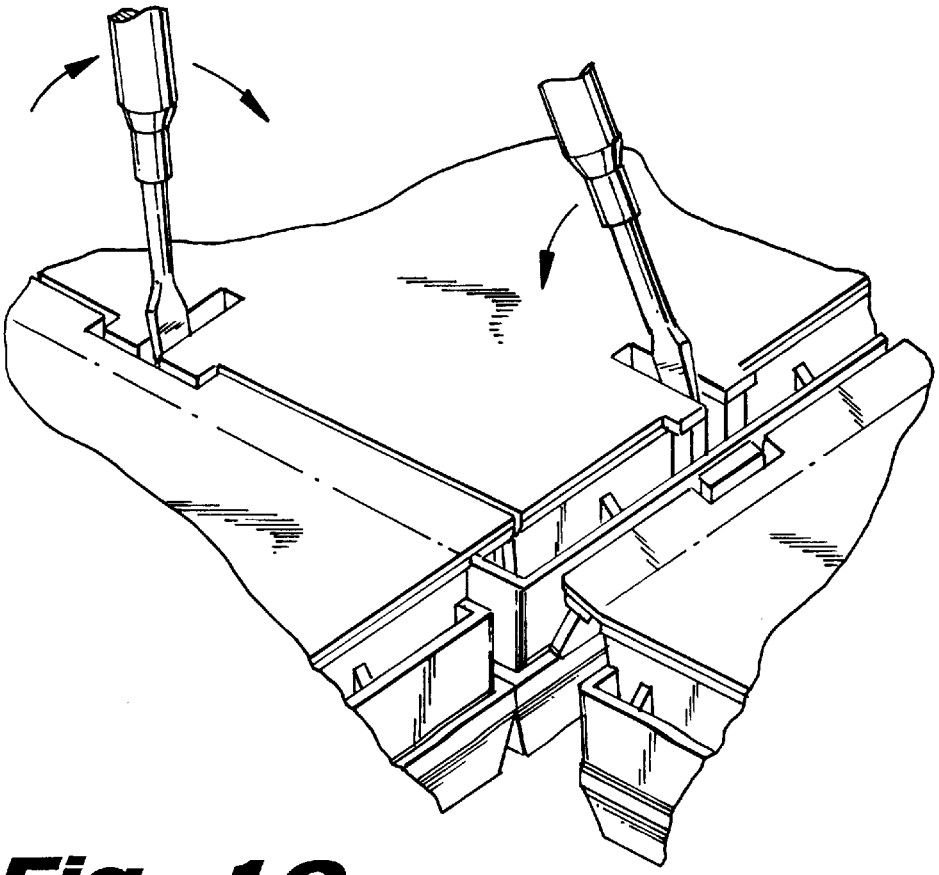
FIG. 10 illustrates the detachment of adjacent treads.

As shown in FIGS. 5 and 6, the treads are interconnected to each other in the same way as is disclosed in applicants applications Ser. No. 08/547,800 and Ser. No. 08/861,977, which applications are incorporated herein by reference. Similarly, insertion members 34 run along the entire length of the male side 20*c* and the male end 20*d*. Correspondingly, receiving members 36 run along the entire length of the female side 20*a* and the female end 20*b*. Interlocking tabs 34*a* are provided having of a resilient tab protrusion, and these tab protrusion are snap fitted into a mating slot 36*a* of an adjacent tread. The insertion member 34 is formed substantially with a U-shaped cross-section 42 and extends substantially along the outside 44 of the long side of the male side portion 20*c* and male end portion 20*d*. The interlocking tabs 34*a* are disposed on the outer portion 44. The female side comprises a channel member 48, said channel member 48 has a substantially U-shaped cross-section and disposed substantially and along the entire length of the female side portion 20*a* and 20*b* and adapted to mate with an insertion member 34 located on an adjacent tread. The mating slots 36*a* are disposed on the channel 48 so as to mate with an interlocking tab 34*a* of an adjacent tread when the insertion member of said interlocking tread is inserted into the channel. The insertion member 34 comprises a hinge 40 which extends substantially parallel and along the entire length of the male side portion 20*c* for allowing the male side portion 20*c* to pivot in relation to said tread. This allows the treads, when interconnected in series to be rolled up for easy handling and storage. The hinge 40*a* on the male end portion 20*d* provides flexibility during connecting the treads and roll-out. The construction and function of the living hinge is also described in applicants previously mentioned applications.

The internal honeycomb structure 22 of the top portion 12 and the honeycomb structure 26 of the lower portion 16 not only provide structural stability that allows a load to be supported by the floor but also serves to trap air to further promote the insulating effect that is being accomplished by the roll-out flooring when covering an ice surface.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A modular roll-out floor suitable for covering an ice surface, comprising a plurality of interconnected treads, each of said treads comprising:

a) a top tread portion having an anti-slip top surface;

b) a lower tread portion; and c) an insulating layer positioned between said top tread portion and said lower tread portion; and wherein the top tread portion includes means for engaging with the lower tread portion.

2. The modular roll-out floor according to claim 1, wherein the lower tread portion includes means for engaging with the top tread portion.

3. The modular roll-out floor according to claim 2, wherein the top tread portion includes a honeycomb structure disposed below the anti-slip top surface.

4. The modular roll-out floor according to claim 3, wherein the lower tread portion comprises a honeycomb structure.

5. The modular roll-out floor according to claim 4, wherein the means for engaging with the lower tread portion is at least one socket.

6. The modular roll-out floor according to claim 5, wherein at least one socket is disposed in the honeycomb structure disposed below the anti-slip top surface.

7. The modular roll-out floor according to claim 6, wherein the means for engaging with the top tread portion is at least one prong.

8. The modular roll-out floor according to claim 7, wherein the at least ore socket and the at least one prong form an engagement.

9. The modular roll-out floor according to claim 7, wherein the at least one socket and the at least one prong ape affixed to each other.

10. The modular roll-out floor according to claim 7, wherein the at least one socket and the at least one prong are affixed to each other by sonic welding.

11. The modular roll-out floor according to claim 7, wherein the at least one socket and the at least one prong are affixed to each other by a snap lock.

12. The modular roll-out floor according to claim 1, wherein the lower tread portion includes ice-engaging means.

13. The modular roll-out floor according to claim 4, wherein the honeycomb structure of the lower tread portion comprises a plurality of ice-engaging means.

14. The modular roll-out floor according to claim 12, wherein he ice-engaging means are spikes.

15. The modular roll-out floor according to claim 1, wherein the top tread portion comprises a male side, a female side, a male end and a female end and interconnecting means for selectively disengageable interconnection with adjacent treads to configure said modular roll-out floor in variable sizes as desired, wherein said interconnecting means comprises interlocking tab means disposed on the male side of said tread and mating slot means disposed on the female side portion of said tread, said mating slot means being arranged so as to mate with interlocking tab means of an adjacent tread in selectively disengageable interconnection therewith.

16. The modular roll-out floor according to claim 15, wherein said interlocking tab means are comprised of a resilient tab protrusion, and wherein said tab protrusion is caused to snap fit into a mating slot means of an adjacent tread;

wherein said male side comprises an insertion member, said insertion member being an inverted substantially U-shaped cross-section and disposed substantially along the length thereof, a insertion member comprising an outer portion, and said interlocking tab means are disposed on said outer portion; and wherein said female side comprises a channel member, said channel member being in substantially U-shaped cross-section and disposed substantially and along the entire length of the female side and adapted to mate with an insertion member located on an adjacent tread; and wherein said mating slot means are disposed on said channel member so as to mate with an interlocking tab means of an adjacent tread when the insertion member of said interlocking tread is inserted in said channel member; and wherein said insertion member comprises hinge means extending substantially parallel and along the entire length of the male side portion for allowing said male side portion to pivot in relation to said tread and whereby a plurality of treads interconnected in series may be formed into a roll for easy storage thereof.

17. A modular roll-out floor for covering an ice surface and for supporting loads thereon, comprising a plurality of interconnected treads, each of said treads comprising:

a) a top tread portion comprising an anti-slip top surface and a load-bearing internal structure;

b) a lower tread portion comprising a smooth surface and having a load bearing internal structure; and c) a thermal barrier sandwiched between said top tread portion and said lower tread portion;

wherein the top tread portion and the lower tread portion are manufactured by injection molding; and wherein the top tread portion further comprises interlocking tabs for interlocking with an adjacent tread on one side and mating slot means for interconnecting with an adjacent tread on a second side.

18. The modular roll-out floor according to claim 17, wherein the top tread portion further comprises hinge means for facilitating rolling up a plurality of treads interconnected in series.

* * * * *

UNITED STATES PATENT AND TRADEMARK OFFICE

CERTIFICATE OF CORRECTION

PATENT NO. : 6,032,428

DATED : March 7, 2000

INVENTOR(S) : Robert J. ROSAN and Arnon J. ROSAN

It is certified that error appears in the above-identified patent and that said Letters Patent is hereby corrected as shown below:

Title page, -- [73] Assignee: Please add place of residence

--Leander, TX--.

Signed and Sealed this

Eighth Day of May, 2001

*Attest:*

Nicholas P. Godici

NICHOLAS P. GODICI

*Attesting Officer*

*Acting Director of the United States Patent and Trademark Office*